48-197
10/15/85 OR 4,547,203

United States Patent [19]
Jahnke

[11] Patent Number: 4,547,203
[45] Date of Patent: Oct. 15, 1985

[54] PARTIAL OXIDATION PROCESS

[75] Inventor: Frederick C. Jahnke, Rye, N.Y.

[73] Assignee: Texaco Development Corporation, White Plains, N.Y.

[21] Appl. No.: 595,103

[22] Filed: Mar. 30, 1984

[51] Int. Cl.[4] ..... C10J 3/46
[52] U.S. Cl. ..... 48/197 R; 48/206; 48/215; 252/373
[58] Field of Search ..... 252/373; 48/206, 215, 48/197 R

[56] References Cited

U.S. PATENT DOCUMENTS

| | | | |
|---|---|---|---|
| 3,010,813 | 11/1961 | Clarke et al. | 48/215 |
| 3,951,617 | 4/1976 | Crouch | 252/373 |
| 3,998,609 | 12/1976 | Crouch et al. | 252/373 |
| 4,060,397 | 11/1977 | Buiter et al. | 252/373 |
| 4,411,670 | 10/1983 | Marion et al. | 252/373 |

*Primary Examiner*—Peter Kratz
*Attorney, Agent, or Firm*—Robert A. Kulason; James J. O'Loughlin; Albert Brent

[57] ABSTRACT

A process is provided for the partial oxidation of a high metals or ash containing liquid hydrocarbonaceous fuel or a slurry of solid carbonaceous fuel to simultaneously produce saturated and unsaturated raw streams of synthesis gas, reducing gas, or fuel gas. Two continuous partial oxidation reactions in two separate reaction zones go on simultaneously. The fuel feed to the first partial oxidation zone is said fresh high metals or ash containing fuel. The raw product gas stream from the first partial oxidation zone is split into first and second split gas streams. The first split gas stream may be cooled in a radiant and/or convection type gas cooler without fouling heat exchange surfaces. The fuel feed to the second partial oxidation zone is a pumpable slurry which is prepared from the entrained matter that is separated from said gas streams during quench cooling and cleaning operations and which contains a comparatively high amount of metals and/or ash. The partial oxidation reaction takes place in the second partial oxidation zone in a reducing atmosphere that includes the second split raw product gas stream from the first partial oxidation zone. By the subject process, there is a reduction in the unconverted carbon produced without any significant loss in efficiency. Further, the life of the cooler for the raw product gas stream is increased.

12 Claims, 2 Drawing Figures

SYNTHESIS GAS GENERATING ZONE
TO ENERGY UTILIZING MEANS

PARTIAL OXIDATION PROCESS

BACKGROUND OF THE INVENTION

This invention relates to a process for the partial oxidation of high metals or ash containing liquid hydrocarbonaceous or a slurry of solid carbonaceous fuel to produce synthesis gas, reducing gas or fuel gas.

When gasifying heavy oil, coke or other feedstock with a high metals or ash content in admixture with recycle feed, the ash in the fresh feed may be increased by the addition of any ash that may be contained in the recycle fuel feed. In some cases, the higher ash content of the total feed (fresh plus recycle) may cause fouling of the waste heat recovery system located just downstream from the gasifier. This fouling tendency may be reduced by splitting part of the flow to a quench section such as described in coassigned U.S. Pat. Nos. 3,998,609 and 4,411,670, which are incorporated herein by reference. By the subject invention, the tendency for fouling of waste heat recovery equipment is reduced still further, and the net unconverted carbon produced may be also reduced without lowering the cold gas efficiency. The cold gas efficiency is the ratio of the higher heating value of the product gas times 100 divided by the higher heating value of the fuel fed to the gas generator. Ordinarily, there is a drop in cold gas efficiency above a certain level of atomic O/C ratio and conversion. This level is raised by the subject invention so that the net unconverted carbon produced may be reduced without lowering the cold gas efficiency.

Coassigned U.S. Pat. Nos. 3,232,728 and 3,639,261 relate to quenching and scrubbing of raw synthesis gas with water or oil to produce clean gas. Soot recovery and recycle to the gas generator as a portion of the feed is described in coassigned U.S. Pat. Nos. 2,999,741; 3,044,179 and 4,134,740. These coassigned U.S. patents are incorporated herein by reference. In U.S. Pat. Nos. 4,060,397 and 4,407,206 all of the gaseous effluent from one combustion zone is further reacted in a second zone. In comparison with the subject invention, the processes in these two patents provide no simultaneous production of two split streams of gas, one stream saturated and the other unsaturated. Further, unlike the subject invention, they provide no cleaning of the product gas to produce a slurry of particulate carbon, soot and ash which is fed through a burner and reacted by partial oxidation in a reducing atmosphere that includes one of the split streams of gas.

SUMMARY

A fresh fuel feedstream comprising a high metals or ash-containing liquid hydrocarbonaceous fuel or a slurry of solid carbonaceous fuel is continuously reacted by partial oxidation in a first gas generating zone to produce a raw stream of synthesis gas, reducing gas, or fuel gas. All of the gas stream from the first gas generating zone is split into two separate split gas streams. One split gas stream is cooled in an energy utilizing means such as an expansion turbine or a convection-type gas cooler without fouling the heat exchange surfaces or plugging the tube passages. An unsaturated stream of synthesis gas, reducing gas, or fuel gas is thereby produced. The entrained matter comprising particulate carbon, soot, ash, optionally unburned solid carbonaceous fuel, and mixtures thereof that is recovered from both split gas streams as a pumpable slurry is introduced as feed to a second partial oxidation gas generating zone. Simultaneously with the partial oxidation reaction going on in the first partial oxidation gas generating zone, the partial oxidation reaction going on in the second partial oxidation reaction zone takes place in a reducing atmosphere that includes preferably all of the second split gas stream. All of the raw product gas produced in the second partial oxidation gas generating zone is quench cooled in water and scrubbed to produce a saturated stream of synthesis gas, reducing gas, or fuel gas. The pumpable slurry is introduced into the second partial oxidation reaction zone by means of a burner which discharges into a lower vertical cylindrical free-flow chamber or alternatively into a connecting passage of reduced diameter which connects the gas splitting chamber with said lower vertical free-flow chamber.

BRIEF DESCRIPTION OF THE DRAWING

The invention will be further understood by reference to the accompanying drawings.

DESCRIPTION OF THE PREFERRED EMBODIMENTS

Figure 1:
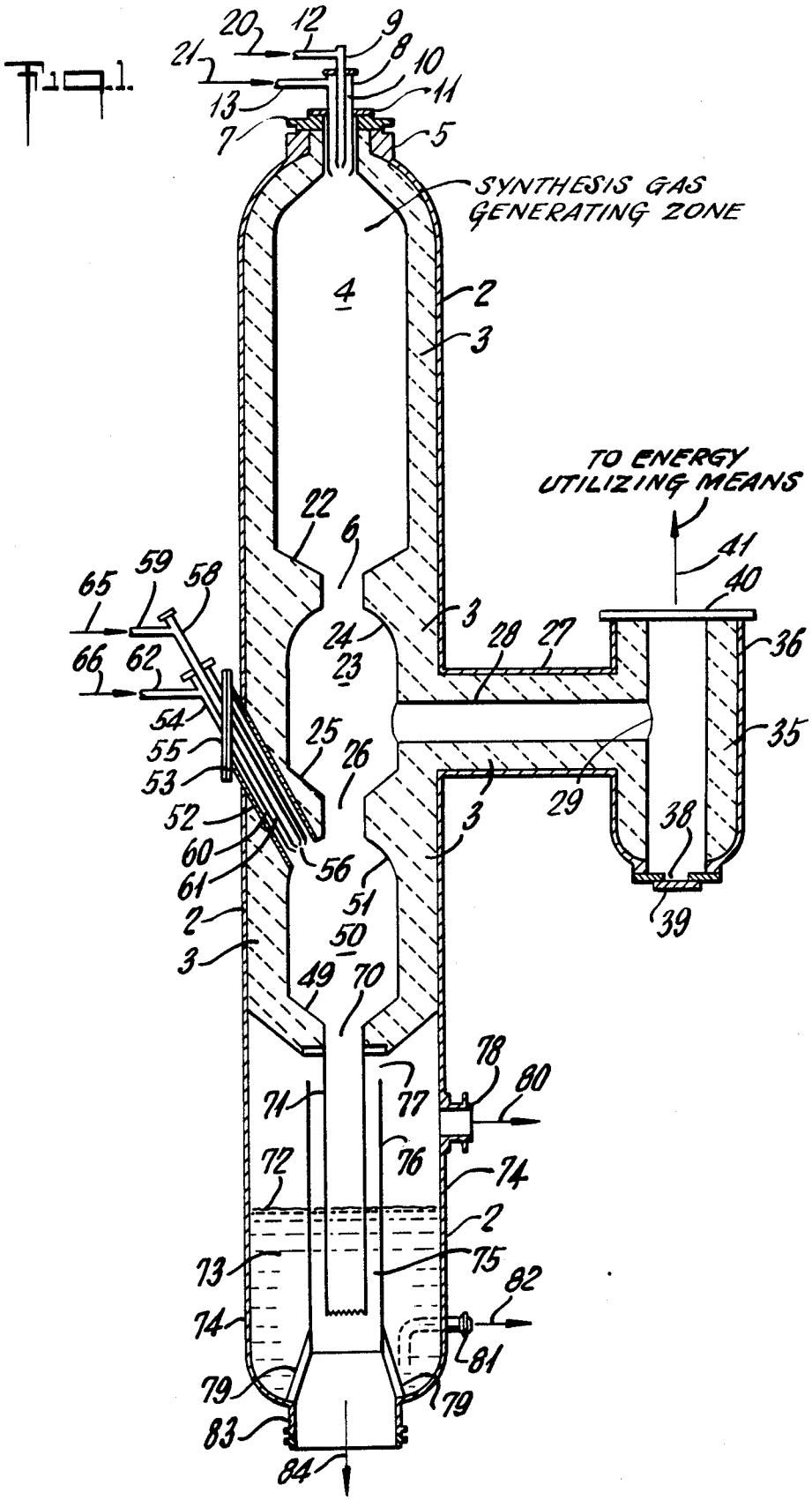
FIG. 1 is a schematic representation of a preferred embodiment of the process.

A more complete understanding of the invention may be had by reference to FIG. 1 of the accompanying drawing which illustrates one embodiment of the invention. In FIG. 1 the upper portion of primary synthesis gas generating zone 1 comprises vertical steel cylindrical shell 2, refractory lining 3, elongated primary partial oxidation reaction chamber 4, coaxial upper central inlet 5, and coaxial bottom central outlet 6. Upper inlet flange 7 is bolted to the upstream end of central inlet 5. Single annulus-type primary burner 8 comprising central conduit 9, annular passage 10, and mounting flange 11 is passed longitudinally through central inlet 5 and is held in position by bolting together flanges 7 and 11. Preferably, the burner is water cooled. Inlet 12 is connected to central conduit 9, and inlet 13 is connected to annular passage 10. Other suitable burners may be used. A high metals or ash containing liquid hydrocarbonaceous or slurry of solid carbonaceous fuel in line 20 is passed through inlet 12 and central conduit 9 of burner 8 and into cylindrical downflowing unobstructed first partial oxidation reaction zone 4. There the fuel mixes and continuously reacts by partial oxidation with a mixture of free-oxygen containing gas and optionally a temperature moderator, e.g. steam from line 21, inlet 13 and annual passage 10. The burner passages through which the feedstreams pass may be interchanged. Further, the temperature moderator e.g. steam, $N_2$, $CO_2$, may be passed through a separate passage in a three-stream burner, or mixed with the liquid hydrocarbonaceous fuel or slurry of solid carbonaceous fuel. No supplemental temperature moderator is required when the slurry feedstream already includes a temperature moderator, such as water slurries. A reducing atmosphere is maintained in first reaction zone 4. The reaction conditions in reaction zone 4 follow: temperature about 1700°-3000° F., such as about 2300°-2400° F.; pressure about 1-250 atm., such as about 30-100 atm.; atomic O/C ratio about 0.7 to 1.3, such as about 0.85-0.95; and weight ratio $H_2O$/fuel about 0.3 to 0.5, and dwell time 0.5 to 10.0 seconds. A raw gas stream comprising $H_2$, CO, $CO_2$ and at least one material selected from the group consisting of $H_2O$, $N_2$, A, $CH_4$, $H_2S$ and COS and also including entrained matter comprising particulate carbon, soot, ash, optionally unreacted solid carbonaceous fuel, and mixtures thereof leaves reaction zone 4 by way of lower central outlet passage 6. About 0 to 10 wt. % such as about 2-5 wt. % of the total fuel feed may be entrained as unburned solid fuel in the raw gas stream departing through passage 6. Bottom 22 of reaction chamber 4 may be frusto-conical or hemispherical shaped.

The hot raw gas stream from passage 6 discharges downwardly into refractory 3 lined free-flow chamber 23 where it is split into two gas streams. Chamber 23 may have for example a vertical cylindrical shape with a hemispherical or diverging frusto-conical shaped dome 24 and a converging hemispherical or converging frusto-conical bottom 25 that discharges into central bottom coaxial cylindrical outlet passage 26. The diameter of connecting passage 26 is smaller than or equal to that of gas-splitting chamber 23. Alternatively, chamber 23 may have other shapes, e.g. spherical. Refractory 3 lined transfer line 27 is connected between outlet 28 in the side wall of chamber 23 and inlet 29 of refractory 35 lined catch pot 36. Transfer line 27 may be horizontal or inclined upward or downward.

From about 10 to 95 volume %, such as about 50 to 85 volume % of the raw gas stream that enters chamber 23 may leave through side outlet 28, and then pass into catch pot 36 by way of transfer line 27. In another embodiment not shown, catch pot 36 comprises a quench tank similar to 74 in the drawing. In such case, the split side gas stream from transfer line 27 is passed through a conventional dip leg and is discharged below the level of a quench cooling and gas cleaning fluid, e.g., water, liquid hydrocarbon that is contained in the bottom of the quench tank.

Since the velocity of the raw gas stream immediately after entering chamber 23 is reduced, entrained solid matter separates so that the concentration of entrained solid matter in the split stream of gas discharged through bottom passage 26 is greater than that in the split stream of gas being simultaneously discharged through side outlet 28. Additional entrained matter in the hot raw gas stream entering catch pot 36 may separate out and be removed periodically through bottom outlet 38 which is otherwise covered with blind flange 39. Since a large portion of the entrained solids have been removed, the hot raw gas stream may be passed upward through upper outlet 40 and line 41 into a conventional energy utilizing means, such as a gas cooler or gas turbine. The gas cooler may be, for example, a conventional radiant and/or convection type tubular boiler. By indirect heat exchange with boiler feed water, a portion of the sensible heat in the first split gas stream may be thereby recovered. Saturated and/or superheated steam may be thereby produced. Further, the first split gas stream of unsaturated synthesis gas, fuel gas, or reducing gas depending on the composition, may be thereby cooled to a temperature in the range of about 500° to 1800° F. Since a large portion of the entrained matter, e.g. about 25-75 wt. % is removed from the first split gas stream before it enters the energy utilizing means, the useful life of the equipment is extended and process shutdowns may be avoided.

In one embodiment (not shown), optionally the partially cooled gas stream leaving the energy utilizing means such as the gas cooler, is passed through a gas scrubber. Substantially, all of the entrained matter that may be in the gas stream may be then removed by contacting the gas stream with a scrubbing fluid in the gas scrubber. The scrubbing fluid may be water or a liquid hydrocarbon fuel. A clean product stream of synthesis gas, reducing gas or fuel gas is thereby produced, along with a dispersion comprising scrubbing fluid and entrained matter, e.g. particulate carbon, ash, slag, and unreacted solid carbonaceous fuel. The dispersion is burned as fuel in a second partial oxidation reaction zone in the manner to be described below. When the quench and/or scrubbing fluid is water, then it is necessary to concentrate the dispersion before burning. Concentration is not required with liquid hydrocarbon quench and/or scrubbing fluids.

The second split gas stream comprising the remainder of the raw gas stream in chamber 23 leaves through bottom cylindrical outlet passage 26 and passes into second cylindrical unobstructed refractory 3 lined downflowing chamber 50. The diameter of passage 26 is about 0.1 to 1.0, such as 0.2 to 0.5 times the diameter of chamber 23. Chamber 50 may preferably have a vertical cylindrical shape with a hemispherical or frusto-conical shaped dome 51 and bottom 49. Alternatively, chamber 50 may have other shapes, e.g. spherical. Preferably, the central vertical axis for chambers 4, 23, and 50 are coaxial and the three chambers are in tandem. However, in one embodiment, chambers 23 and 24 are merged into one chamber, thereby eliminating connecting passage 26.

In the subject process, two partial oxidation reactions go on simultaneously in the two separate partial oxidation reaction chambers 4 and 50. In the embodiment shown in FIG. 1, secondary partial oxidation reaction chamber 50 is provided with an inclined downwardly directed inlet sleeve 52 that passes through steel shell 2 and refractory 3 and which terminates near the upstream end of chamber 50. Sleeve 52 is provided with external flange 53 at its upstream end. In another embodiment shown in FIG. 2 to be described later, sleeve 115 terminates in the vertical wall of passage 26 and is perpendicular to the vertical central axis of passage 26. Single annulus-type burner 54 in FIG. 1 is passed downward through sleeve 52 and is provided with flange 55 for securing the burner in place by bolting together flanges 53 and 54. Preferably, the burner is water cooled. The downstream tip 56 of burner 54 is located at or near the downstream end of conduit 52 in dome 51. Burner 54 comprises central conduit 58, outer conduit 60, and annular passage 61 located in between conduits 58 and 60. Inlet 59 is connected to central conduit 58, and inlet 62 is connected to annular passage 61. Other suitable burners may be used.

A pumpable dispersion of entrained matter and scrubbing fluid having a solids content in the range of about 0.1 to 10.0 wt. % is obtained from the gas quench cooling and scrubbing zone(s) to be further described. Water dispersions are concentrated by conventional methods to produce a pumpable slurry having a solids content in the range of about 30 to 75 wt. %, such as about 50 to 65 wt. %. No concentration is required for pumpable liquid hydrocarbon dispersions, which may for example have a solids content in the range of about 2 to 10 weight %. Pumpable water dispersions of entrained matter from the gas quench cooling and scrubbing zone(s) may be concentrated by conventional methods including settling, filtration, centrifuge, hydroclone, and combinations thereof. The slurry, with or without preheat, is then passed through central conduit 58 of burner 54. Simultaneously, a stream of free-oxygen containing gas optionally in admixture with a temperature moderator such as steam, in line 66 is passed through inlet 62 and annular passage 61. The reactant streams impact together, mix and continuously react by partial oxidation in reaction zone 50. The partial oxidation reaction takes place in a reducing atmosphere that includes preferably substantially all of the second split gas stream. A portion of the second split gas stream may also react by partial oxidation and related reactions in reaction zone 50, thereby substantially reducing the amount of entrained matter. A third stream of raw synthesis gas, reducing gas, or fuel gas is thereby produced in reaction zone 50 comprising $H_2$, CO, $CO_2$, and at least one material selected from the group consisting of $H_2O$, $N_2$, A, $CH_4$, $H_2S$ and COS, and containing entrained matter, e.g., particulate carbon, soot, ash, optionally unreacted solid carbonaceous fuel, and mixtures thereof. By this means a substantial portion, e.g. about 10–75 weight % say about 40–50 weight %, of the entrained particulate matter comprising soot, unburned solid fuel and ash that may be entrained in the second split gas stream from chamber 23 is converted into gaseous products before leaving the secondary partial oxidation reaction zone 50. The conditions of reaction in the secondary partial oxidation zone 50 may be the same as those in the primary partial oxidation reaction zone 4. However, preferably, the temperature and atomic oxygen/carbon ratio are greater in the secondary partial oxidation zone 50 than in the primary partial oxidation zone 4. For example, the temperature in chamber 50 may be from about 0°–500° F., such as about 100°–300° F. greater than the temperature in primary reaction zone 1. The pressure in and between areas 4, 23, 26, and 50 is substantially the same, less ordinary pressure drop in the lines. The preferred operating conditions in secondary reaction zone 50 follow: $H_2O$/fuel weight ratio about 0.4–0.7, such as about 0.5–0.7; atomic O/C ratio about 1.0–1.2 times, such as 1.05–1.15 times, the atomic O/C ratio in primary reaction zone 4; and dwell time about 0.5 to 10 sec. The volume of the secondary partial oxidation reaction zone, e.g. 50 is smaller than that of the primary partial oxidation reaction zone, e.g., 4 since only about 2–25 volume % such as about 3–10 volume %, of the total effluent gas stream is generated there.

All of the hot raw gas stream departing from chamber 50 passes through central bottom exit passage 70, dip tube 71, and is discharged under liquid level 72 of quench fluid 73 contained in the bottom of vertical cylindrical quench tank 74. The quench cooled and washed gas stream passes up through annular passage 75 located between dip tube 71 and spaced outer vertical draft tube 76, annular passage 77 at the top of draft tube 76, and leaves by side outlet 78 located in steel wall 2 of quench tank 74 above water level 72. Draft tube 76 is supported at the bottom by braces 79. The quench cooled gas stream leaving through outlet 78 is saturated with quench fluid vapor, for example $H_2O$. If necessary, the hot gas stream may be passed through line 80 and into a gas scrubber (not shown) for additional cleaning. The clean saturated gas stream comprises $H_2$, CO, $CO_2$ and at least one material from the group consisting of $H_2O$, $N_2$, A, $CH_4$, $H_2S$ and COS. Depending on the actual composition, the gas may be used as synthesis gas, reducing gas, or fuel gas. The dispersion of entrained matter and quench fluid 73 is removed through side outlet 81 and line 82 located near the bottom of quench tank 74. When the quench fluid is water, the water dispersions are sent to a concentrating zone, as previously described. Periodically, quench tank 74 is cleaned out through central bottom outlet 83 and line 84.

As shown in the drawing, preferably primary reaction zone 4, chamber 23, secondary reaction zone 50 and quench chamber 74 are coaxial, vertically aligned and interconnected so that the gaseous materials flow downwardly from one chamber to the next in said order. Further these chambers are preferably contained in the same vertical cylindrical steel shell 2. However, in another embodiment (not shown), each of said chambers is provided with an upper flanged inlet and a lower flanged outlet. The apparatus is assembled by bolting the lower flanged outlet of one chamber to the upper flanged inlet of the next chamber in the line.

Figure 2:
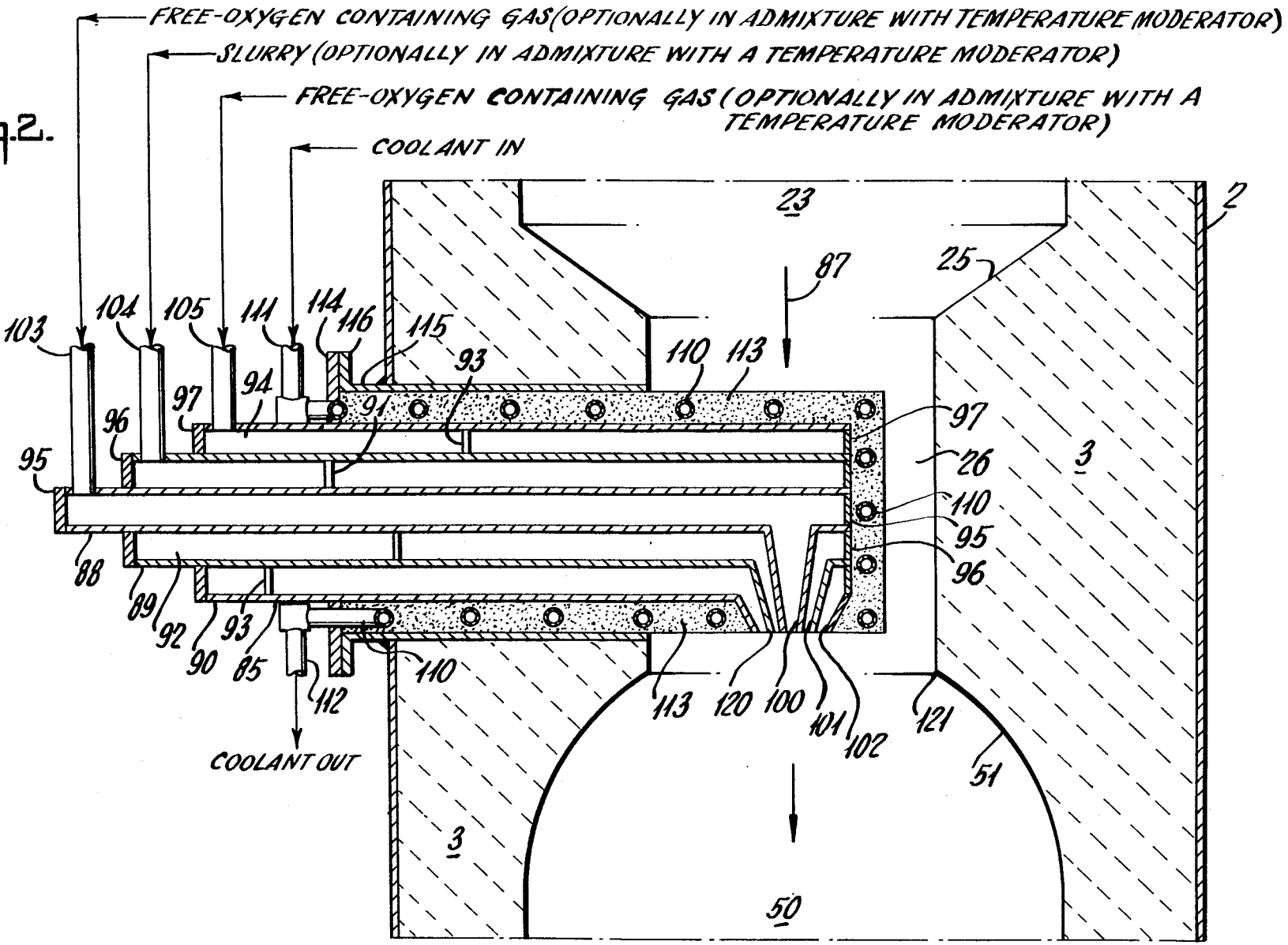
FIG. 2 is a schematic representation of one embodiment of the invention showing a novel horizontal burner for introducing feedstreams into a secondary partial oxidation reaction zone.

FIG. 2 is a schematic representation of one embodiment of the invention showing an enlarged portion of refractory 3 lined steel vessel 2 in the region around passage 26 which connects the frusto-conical bottom 25 of gas splitting chamber 23 with hemispherical dome 51 of free-flow reaction chamber 50. Three-stream horizontal burner 85 in FIG. 2 replaces two-stream inclined burner 54 in FIG. 1.

The horizontal longitudinal central axis of burner 85 is perpendicular to the longitudinal central axis of vessel 2 and connecting passage 26. Whereas in most burners the central longitudinal axis of the discharge nozzle and that of the burner are coaxial, in burner 85 they are perpendicular. By this means, the direction of the feedstreams passing through burner 85 may be changed so that they may be discharged downwardly in the general direction of the split raw gas stream 87 flowing through passage 26 from gas splitting chamber 23.

Burner 85 comprises central conduit 88, coaxial intermediate conduit 89, and coaxial outer conduit 90. Central conduit 88 and intermediate conduit 89 are radially spaced by spacers 91 to provide inner annular passage 92 between the outside peripheral surface of central conduit 88 and the inside perpheral surface of intermediate conduit 89. Intermediate conduit 89 and outer conduit 90 are radially spaced by spacers 93 to provide outer annular passage 94 between the inside peripheral surface of outer conduit 90 and the outside peripheral surface of intermediate conduit 89. Disc shaped end plates 95 close off and seal the upstream and downstream ends of central conduit 88. Annular shaped end plates 96 and 97 respectively close off and seal the upstream and downstream ends of inner annular passage 92 and outer annular passage 93.

Downwardly discharging vertical coaxial converging frusto-conical shaped nozzles 100, 101, and 102 are respectively connected to central conduit 88, intermediate conduit 89, and outer conduit 90 near their downstream ends. Feedstream inlet conduits 103, 104, and 105 are respectively connected to central conduit 88, intermediate conduit 89, and outer conduit 90, near their upstream ends. The outside peripheral surface of burner 85 is contacted by cooling coils 110. A coolant is introduced into coils 110 by way of line 111 and is removed through line 112. Preferably, thermal refractory 113 covers the outside peripheral surface of burner 85. Mounting flange 114 is perpendicularly attached to the outside diameter of burner 85.

Burner 85 is installed with the help of horizontal sleeve 115 which passes through steel shell 2 and refractory 3. Burner 85 is secured in place by bolting flange 114 to flange 116 located at the external end of sleeve 115. Suitable gasketing is provided to make a pressure-tight seal. The downstream tips of discharge nozzles 100, 101 and 102 may terminate in the same plane perpendicular to the vertical central axis of passage 26 at face 120 of the burner. Alternatively, the tips of nozzles 100 and optionally 101 may be retracted upstream from the downstream tip of vertical coaxial frusto-conical shaped discharge nozzle 102 at burner face 120, a distance of from about 0 to 3, such as about 0.5 to 2.0, times the minimum inside diameter of converging frusto-conical shaped nozzle 102 at downstream face 120. Face 120 of burner 85 may be retracted upstream from the downstream end 121 of passage 26 a distance of about 0 to 1.0 times the diameter of passage 26, such as about 0.2 to 0.5 times the inside diameter. The length to width ratio of passage 26 may be in the range of about 0.2 to 8, such as about 0.5 to 2.

Alternatively, the horizontal burner may be assembled with flanges at the outside end of the passages and with separate seals at the other ends to allow disassembly of the burner parts. In this mode, nozzles 100 and 101 would be shortened slightly to enable them to be withdrawn through the flanged ends of the burner.

During operation, preferably free-oxygen containing gas, optionally in admixture with a temperature moderator, is passed through feedstream inlet lines 103 and 105 while simultaneously a slurry of entrained matter, as previously described, optionally in admixture with a temperature moderator, is passed through feedstream inlet line 104. Atomization of the slurry feedstream and mixing and reaction with the free-oxygen containing gas then takes place in passage 26, chamber 50, or both while in a reducing atmosphere that includes the second split stream from chamber 23. Under substantially the same partial oxidation reaction conditions as described previously in connection with FIG. 1, a third stream of raw synthesis gas, reducing gas, or fuel gas is thereby produced. The third gas stream is quench cooled and washed in quench tank 74 to produce a saturated gas stream in the manner described previously.

Although modifications and variations of the invention may be made without departing from the spirit and scope thereof, only such limitations should be imposed as are indicated in the appended claims.

I claim:

1. A partial oxidation process comprising:

(1) reacting a primary fuel and free-oxygen containing gas mixture comprising a high metal or ash containing liquid hydrocarbonaceous or a pumpable slurry of solid carbonaceous fuel, a free-oxygen containing gas, and optionally a temperature moderator in a first reaction zone under partial oxidation reaction conditions to produce a first raw gas stream comprising $H_2$, CO, $CO_2$, at least one material selected from the group consisting of $H_2O$, $N_2$, A, $CH_4$, $H_2S$ and COS and also including entrained matter comprising particulate carbon, soot, ash, optionally unreacted solid carbonaceous fuel, and mixtures thereof;

(2) splitting the raw gas stream from (1) in a gas splitting zone into a first split gas stream comprising about 10–95 volume % of the total raw gas stream and a second split gas stream comprising the remainder;

(3) cooling the first split gas stream from (2);

(4) optionally cleaning the gas stream from (3) by direct contact with a scrubbing fluid to produce a clean gas stream and a dispersion of said entrained matter;

(5) reacting by partial oxidation a secondary fuel and free-oxygen containing gas mixture comprising a free-oxygen containing gas, a pumpable slurry of entrained matter from (7) and optionally a temperature moderator; wherein said partial oxidation reaction takes place downstream from said first partial oxidation reaction zone and in a reducing atmosphere that includes said second split gas stream, and producing thereby a third raw gas stream comprising $H_2$, CO, $CO_2$, at least one material selected from the group consisting of $H_2O$, $N_2$, A, $CH_4$, $H_2S$ and COS, and containing entrained matter;

(6) quench cooling and cleaning by immersion in a quench fluid and optionally scrubbing the third raw gas mixture from (5), thereby producing a clean gas stream saturated with quench fluid, and a dispersion of entrained matter; and (7) concentrating the dispersion of entrained matter from (6) and optionally (4) if any to produce a pumpable slurry.

2. The process of claim 1 provided with the steps of passing the second split gas stream from (2) downward through a connecting passage of smaller diameter than said gas splitting zone and then expanding the second split gas stream into a lower coaxial free-flow chamber.

3. The process of claim 2 wherein the partial oxidation reaction in (5) takes place in said connecting passage and/or in said lower free-flow chamber.

4. The process of claim 2 wherein said secondary fuel and free-oxygen containing gas mixture is reacted in said connecting passage and/or in said lower chamber by introducing the free-oxygen containing gas, the slurry of entrained matter, and optionally a temperature moderator into said connecting passage or into said lower free-flow chamber, respectively, by way of a separate burner.

5. The process of claim 2 wherein said secondary fuel and free-oxygen containing gas mixture is introduced into said connecting passage or into said lower free-flow chamber by passing the free-oxygen containing gas, optionally in admixture with a temperature moderator, through the central or annular passage of a two stream annular-type burner; and simultaneously passing the slurry of entrained matter, optionally in admixture with a temperature moderator, through the remaining passage of the burner.

6. The process of claim 2 wherein said secondary fuel and free-oxygen containing gas mixture with or without a temperature moderator is introduced into said connecting passage or into said lower free-flow chamber by passing the free-oxygen containing gas optionally in admixture with a temperature moderator through the central and outer annular passages of a three-stream annular-type burner; and simultaneously passing the slurry of entrained matter optionally in admixture with a temperature moderator, through the central passage of the burner.

7. The process of claim 2 wherein a reducing atmosphere is maintained in said first free-flow reaction zone, in said gas-splitting zone, in said connecting passage, and in said lower free-flow chamber.

8. The process of claim 1 wherein the quench fluid in (6) is water, and the pumpable slurry in (7) has a solids content in the range of about 30 to 75 weight % after concentration.

9. The process of claim 1 wherein the quench fluid in (6) is a liquid organic fluid, and the pumpable slurry in (7) has a solids content in the range of about 2 to 10 weight %.

10. The process of claim 1 provided with the step of cooling the first split gas stream in (3) by passing said gas stream through a radiant and/or convection-type gas cooler.

11. The process of claim 1 provided with the step of cooling the first split gas stream in (3) by passing said gas stream through an expansion turbine.

12. The process of claim 1 wherein the partial oxidation reaction in (5) takes place at a temperature which is about 0° to 500° F. greater than the temperature of the partial oxidation reaction simultaneously taking place in (1); and the pressure in the reaction zone in (5) is substantially the same as the pressure in the reaction zone in (1), less ordinary pressure drop in the lines.

* * * * *